United States Patent [19]

Hardesty

[11] Patent Number: 4,477,141

[45] Date of Patent: Oct. 16, 1984

[54] TRICOUPLER FOR MODULAR WIRING SYSTEMS

[75] Inventor: Edwin C. Hardesty, Perry Hall, Md.

[73] Assignee: AT&T Technologies, Inc., New York, N.Y.

[21] Appl. No.: 442,931

[22] Filed: Nov. 19, 1982

[51] Int. Cl.[3] ..... H01R 25/00

[52] U.S. Cl. ..... 339/122 R; 339/123; 339/156 R; 339/176 M; 339/204

[58] Field of Search ..... 339/176 M, 204, 205, 339/122 R, 123, 134, 154 R, 154 A, 156 R

[56] References Cited

U.S. PATENT DOCUMENTS

| | | | |
|---|---|---|---|
| 2,158,004 | 5/1939 | Douglas | 339/205 |
| 3,365,696 | 1/1968 | Wagner | 339/159 |
| 4,047,787 | 9/1977 | Gumb et al. | 339/154 A |
| 4,061,411 | 12/1977 | Gumb et al. | 339/159 R |
| 4,146,292 | 3/1979 | Garrett | 339/176 M |
| 4,153,327 | 5/1979 | Johnson | 339/205 |
| 4,220,391 | 9/1980 | Krolak et al. | 339/126 R |
| 4,241,974 | 12/1980 | Hardesty | 339/154 A |
| 4,268,109 | 5/1981 | Hardesty | 339/205 |
| 4,273,402 | 6/1981 | Hughes | 339/91 R |
| 4,406,509 | 9/1983 | Jagen | 339/204 |
| 4,407,559 | 10/1983 | Meyer | 339/176 M |

FOREIGN PATENT DOCUMENTS

| | | | |
|---|---|---|---|
| 524646 | 4/1955 | Italy | 339/205 |

*Primary Examiner*—John McQuade

*Attorney, Agent, or Firm*—E. W. Somers

[57] ABSTRACT

A modular tricoupler (30) is provided for interconnecting lengths of inside wiring in series within walls, for example, of customer premises and to a network interface device (42, see FIG. 3B). The tricoupler also includes provisions for receiving a modular plug (31) which terminates a cord (36) that is connected to customer station equipment. The tricoupler includes a housing (80) having first and second generally opposed plug-receiving cavities (82, 83) and a third cavity (87). A plurality of metallic wire-like contact elements (90–90) are disposed in the housing of the tricoupler and maintained spaced apart by partitions (96–96). One end portion of each contact element extends into the second cavity and the other end portion into the third cavity. Blade-like terminals (60–60) of a modular plug which is inserted into the first cavity engage loop portions (131–131) of the contact elements. The loop portion of each is designed and is supported so that the entire loop shifts when engaged by the terminal. This arrangement allows sufficient deflection of the loop portions to develop suitable contact pressure with terminals of plugs inserted into the cavities without causing a permanent deformation of the wire-like contact elements.

18 Claims, 22 Drawing Figures

TRICOUPLER FOR MODULAR WIRING SYSTEMS

TECHNICAL FIELD

This invention relates to a tricoupler for modular wiring systems and, more particularly, to a modular tricoupler which is used for inside wiring such as telephone service cables, for example, and which includes three modular jack-receiving cavities.

BACKGROUND OF THE INVENTION

Modularity is used widely in telephone communication systems. In a modular system, a modular plug which terminates an end of a telephone cord is inserted into a cavity of a modular jack which is mounted in a wall outlet or in portions of customer station equipment. Typically, a home is equipped with any number of wall outlets each of which includes a modular jack. This allows the customer to move a telephone from room to room ad allows the customer to purchase and to install new telephones and new cords as desired.

A typical telephone wiring system includes a network interface device, a plurality of wire junction devices and wall outlets distributed about the rooms of a home, for example. Inside wiring which includes a relatively small number of insulated conductors enclosed in a plastic jacket is run from an entry junction device which is fed from the interface to a plurality of wall outlets. A line is also run from the entry wire junction device to another junction device to which additional wall outlets are connected. Typically, the plastic jacket must be removed from each end of a length of inside wiring to permit connection of the conductors to the junction devices and wall outlets. There has been a desire to improve the just-described system to simplify the wiring and to provide multiple circuit paths to each wall outlet to decrease the probability of service outage.

Another problem which is addressed by the tricoupler of this invention comes about because of a change from past practices with respect to inside wiring. For many years, installation service was provided by a telephone operating company to each customer premises as requested initially with wiring runs to additional rooms as requested subsequently. Each additional outlet required a visitation by a craftsperson of the telephone operating company. With the advent of modularity, it no longer became necessary for a craftsperson to visit customer premises to connect a telephone into the network. However, this was only true if modular outlet devices had been provided in or on the walls. This led to programs intended to pre-wire customer premises for telephone usage with modular outlet devices positioned in preselected locations during the construction of the premises. Other developments in telephone communications have led to the probable situation where inside wiring may be installed by craftspeople other than telephone operating company personnel.

These developments have led to the desire for more simplistic devices for use in modular wiring systems. Goals include the use of lengths of inside wiring which have been terminated with modular plugs. The plugs which terminate the wiring may be secured to the wiring in a factory environment or in the field. The lengths are connected end to end inside walls with the use of a coupler such as that disclosed and claimed in U.S. Pat. No. 4,,268,109 which issued on May 19, 1981 in the name of E. C. Hardesty. An end of each run of wiring should be easily connectable to the sought-after wall outlet device to which a plug of customer station equipment is also connectable. The sought-after device also should be capable of being mounted externally of a wall, such as along the baseboard molding, for example.

SUMMARY OF THE INVENTION

The foregoing problems which seemingly remain unsolved by the prior art have been overcome by the modular tricoupler of this invention. The tricoupler comprises a housing which is made of a dielectric material and which includes first, second and third modular plug-receiving cavities spaced about the housing. A wire-like contact element is mounted in the housing to cause its end portions which may be retroflexed to be disposed in the second and third cavities and to cause a portion intermediate the end portions to be disposed in the first cavity. When modular plugs are inserted into the cavities, blade-like terminals of the plugs engage the end portions and/or the intermediate portion of the contact element to establish electrical contact therewith. Typically, the tricoupler includes a plurality of contact elements corresponding in number to the terminals within a modular plug to be received in any one of the cavities.

The portion of each contact element intermediate its ends is formed with a loop having a configuration which is predetermined to control the deflection characteristics of the contact element. When a modular plug is inserted into the first cavity, the loops shift to allow sufficient deflection to accommodate the plug terminals with suitable contact pressure being developed between the contact elements and the terminals without permanently deforming the contact elements. Also, terminal contact in the first cavity does not cause the ends of the contact elements to be repositioned to a degree which adversely effects their engagement with terminal blades of plugs inserted into the second and the third cavities.

In a preferred embodiment, two of the cavities generally are opposed to each other and receive plugs which terminate service wiring that is run inside walls of a customer's home or along a baseboard molding. The third cavity, which has an axis generally perpendicular to an axis that extends between the other two cavities, is adapted to receive a modular plug that is connected to customer station equipment.

A wall outlet of this invention includes a receptacle which generally is made of a plastic material and which is securable within a wall. An open side of the receptacle faces outwardly into a room wherein there is located customer equipment to be connected to a network. A plastic cover is attachable to the receptacle and includes means for securing a modular tricoupler to the cover. One cavity of the tricoupler communicates through an opening in the cover to the room to receive a modular plug of the equipment. The other two cavities in the tricoupler are adapted to receive plugs of inside wiring that connect the customer equipment to the network.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
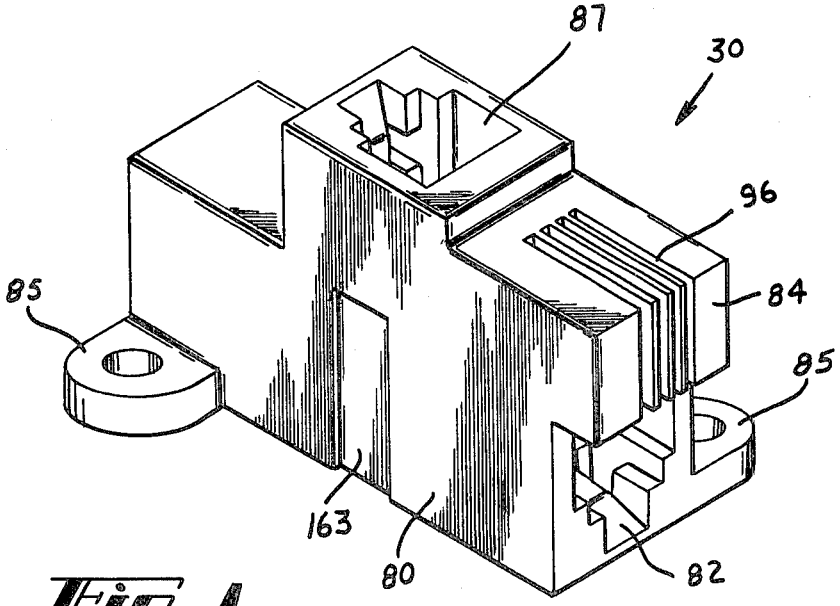
FIG. 1 is a perspective view of a modular tricoupler of this invention.
Figure 2:
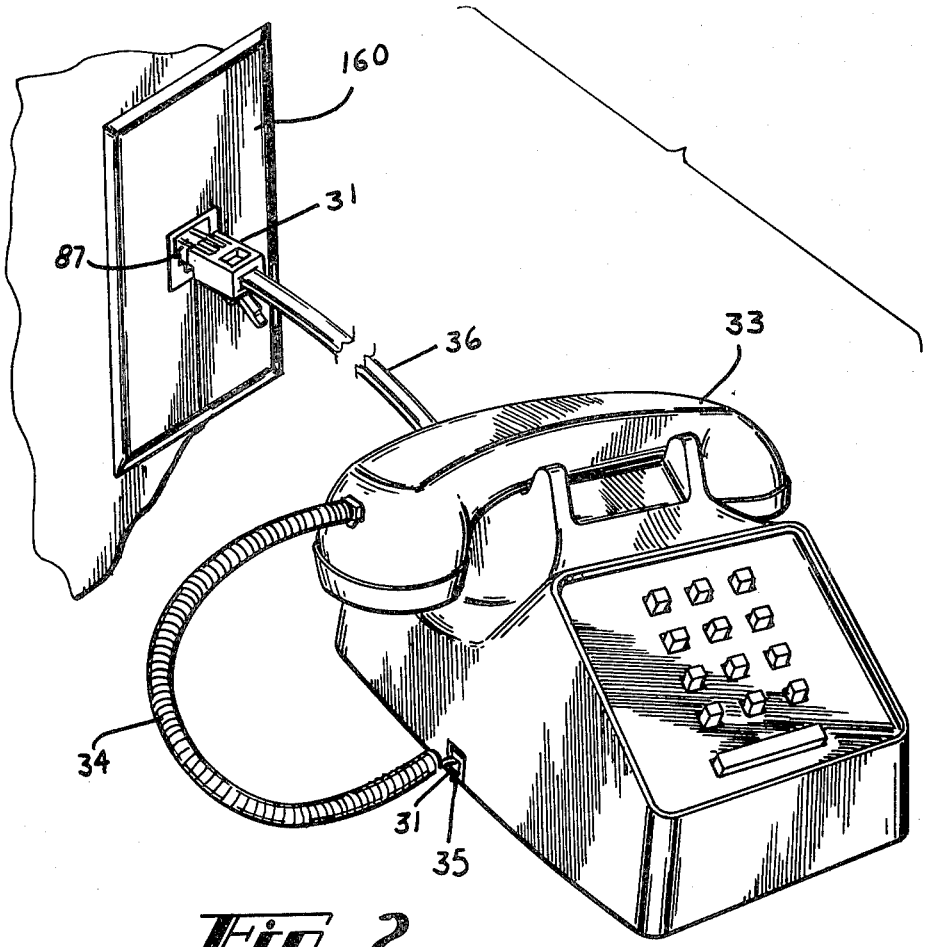
FIG. 2 is a perspective view of a telephone station apparatus connected to a tricoupler of this invention for connection into a network.

Referring now to FIG. 1, there is shown a modular tricoupler which is designated generally by the numeral 30. The tricoupler 30 is used to interconnect modular plugs 31—31 that terminate cords of customer station equipment such as telephone sets and inside wiring. A telephone set 33 (see FIG. 2) includes a base and a handset that are interconnected by a retractile cord 34. The ends of the cord 34 are terminated with modular plugs 31—31 which are received in jacks 35—35 in the base and in the handset. The modular plug 31 may be that shown, for example, in U.S. Pat. No. 4,148,539 which issued on Apr. 10, 1979 in the name of E. C. Hardesty while the jack 35 may be that shown in U.S. Pat. No. 3,990,764 which issued Nov. 9, 1976 in the name of C. L. Krumreich, both of which patents are incorporated by reference hereinto. A single line cord 36 (see FIG. 2) having a modular plug 31 at each end connects the telephone set 33 to the tricoupler 30 when the plugs at the ends of the line cord are inserted into jack cavities in the set and in the tricoupler. Cordage from which the cords 34 and 36 are made may be that disclosed in U.S. Pat. No. 4,166,881 which issued on Sept. 4, 1979 in the names of W. I. Congdon, et al.

Figure 3A:
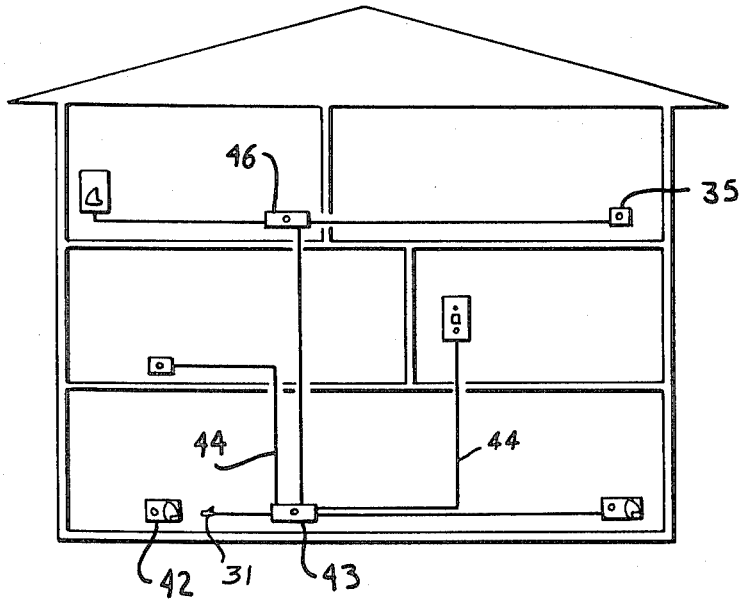
Fig. 3A PRIOR ART
FIG. 3A is an elevational view of a home wiring arrangement using prior art devices.
Figure 3B:
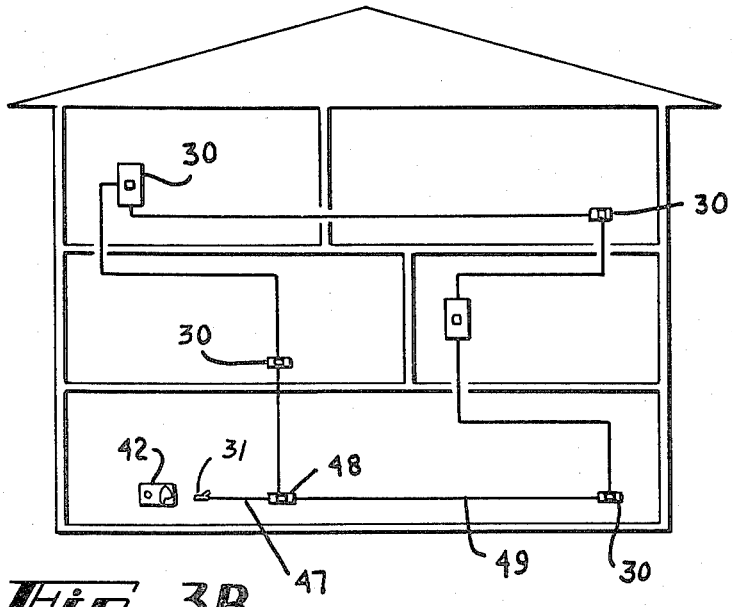
FIG. 3B is an elevational view of a home wiring arrangement using the modular tricoupler of this invention.

The modular tricoupler 30 of this invention is used to facilitate inside communications wiring, particularly residential. It will be recalled that priorly developed customer premise wiring arrangements include a run from a network interface 42 (see FIG. 3A) to a wire junction device 43 from which runs 44—44 are made to modular jacks 35—35 in wall outlets and/or to other wire junction devices 46—46. Because of the modular tricoupler 30 of this invention, the wiring of a home, for example, is done more simply than before. Lengths of inside service wiring are terminated at each end with a modular plug 31 which is insertable into a tricoupler 30 to interconnect the customer station equipment to the network. The modular tricoupler 30 is adapted to interconnect the modular plugs 31—31 which are used to terminate the small pair size inside wiring in the walls or along the baseboard molding and the line cord 36 from the customer station equipment. It should be noted that the modular tricoupler 30 of this invention is not only a coupler inasmuch as it interconnects inside wiring, but also functions as a jack to receive a modular plug of customer station equipment. A run 47 is made from the network interface 42 to an entry tricoupler 48 (see FIG. 3B). From one of its cavities, there are runs in series fashion to other tricouplers 30—30.

The tricoupler 30 of this invention also facilitates the wiring of a premises in a loop. The last tricoupler 30 in the series wiring arrangement may be connected through a length 49 of wiring (see FIG. 3B) back to the entry tricoupler to complete a loop. If an outage occurs on one side of any tricoupler 30 in the loop, service is continued from that coupler back to the entry tricoupler 48 because of its connection to the other side of the loop and the entry tricoupler.

Figure 4:
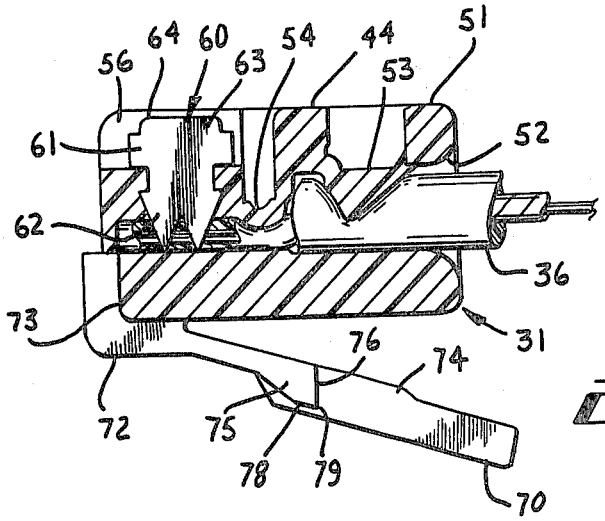
PRIOR ART Fig. 4
FIG. 4 is an elevational view in section of a modular plug that is received in the tricoupler of this invention.

Going now to FIG. 4, there is shown in detail the construction of the modular plug 31 which is used to terminate the cords and the inside wiring. The plug 31 includes a body 51 which may be designed to be constructed in one molded piece from a plastic material by using conventional injection molding techniques. As will be recalled, the plug 31 is described in detail in aforementioned U.S. Pat. No. 4,148,539.

The end of the cord 36 or of a length of inside wiring is received in an aperture 52 at one end of the body 51. The plug 31 is also constructed with strain relief portions 53 and 54 for securing the jacket and the individual conductors of the telephone cord within the body 51.

Each of a plurality of terminal-receiving slots 56—56 in the plug body 51 is adapted to receive a blade-like terminal 60. Each one of the terminals 60—60 shown in FIG. 4 is made from an electrically conductive resilient material such as Phosphor bronze alloy. It has a flat conductive portion 61 with insulation-piercing tangs 62—62 protruding therefrom to provide an electrical connection between the conductive portion of a conductor and the terminal. An edge surface 63 having curved crowns 64—64 completes the connection between the associated conductor of the cord and an associated contact element within the modular tricoupler 30. The tangs 62—62 extend through the aligned conductor and become embedded slightly in the plug body 51. This supplements side support of the terminals 60—60 in the body 51 to prevent unintended movement of the terminals.

Formed integrally with the modular plug body 51 is a resilient locking tab 70 (see again FIG. 4) which extends angularly from the plug body. The locking tab 70 is connected by a plastic hinge to a nose 72 of the plug body 51. A free end of the tab 70 extends beyond the cord-input end of the plug body 51 when the tab is in its non-depressed position. The nose 72 has a width which is less than that of the plug body 51 and is spaced from the side surfaces of the plug body 51 by stepped recesses having faces 73—73. A portion 74 is stepped to form shoulders 75—75 having vertical latching surfaces 76—76 that are joined to flats 78—78 along edges 79—79. The combined height of the plug body 51 and the resiliency of the locking tab 70 facilitates the insertion of the plug into the tricoupler 30 of this invention.

Figure 5:
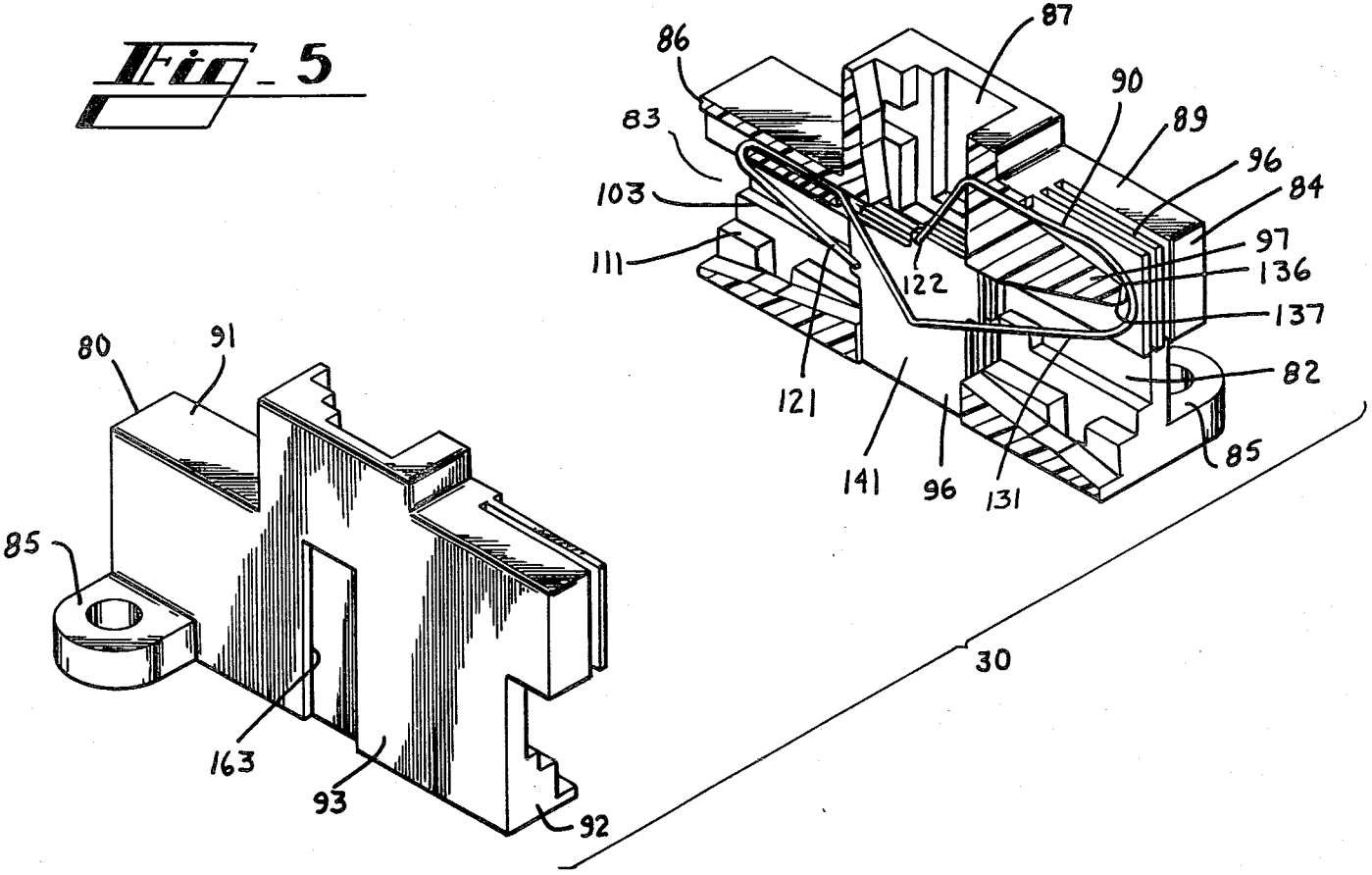
FIG. 5 is a perspective view of the tricoupler of FIG. 1 with portions thereof broken away to show a contact element disposed therein.
Figure 6:
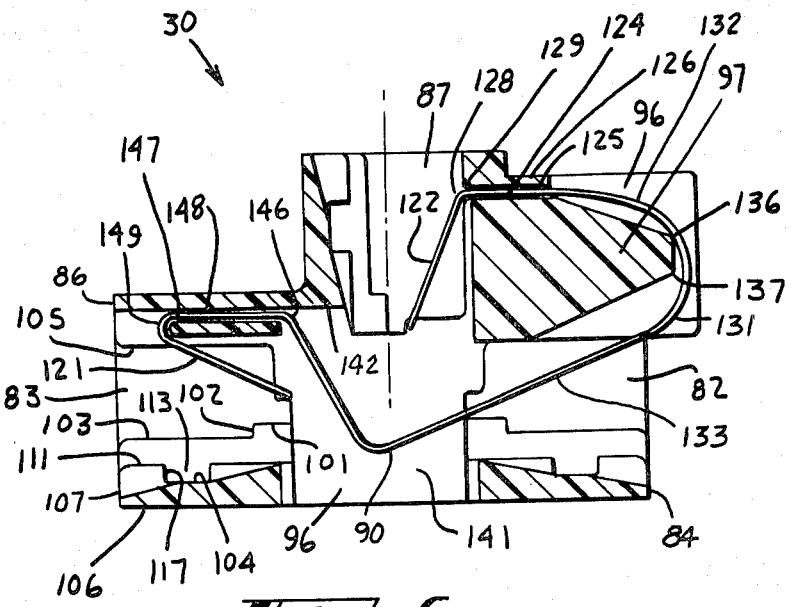
FIG. 6 is an elevational view in section of tricoupler the of FIG. 1.

As can be seen in FIGS. 5 and 6, the modular tricoupler 30 includes a housing 80 having generally opposed first and second plug-receiving cavities 82 and 83 at end portions 84 and 86, respectively and a third cavity 87. The housing 80 is made from a dielectric material such as, for example, polycarbonate, rigid polyvinyl chloride (PVC), acrylonitrile butadiene styrene (ABS), a composition including ABS and PVC, DELRIN® acetal plastic, or polyamide nylon plastic. The tricoupler 30 may be somewhat non-symmetrical about a vertical axis which extends through the cavity 87. The non-symmetry may occur because the opposed cavities 82 and 83 may not be perfectly aligned and the cavity 87 is non-symmetrical about a vertical axis. However, in other embodiments, the cavities 82 and 83 may be aligned and the only non-symmetry occurs because of internal portions of the housing 80. The housing 80 is also provided with laterally extending lugs 85—85 which are used for mounting the tricoupler in engagement with supporting surfaces.

As can be seen from the drawings, the two plug-receiving cavities 82,83 in the preferred embodiment are generally opposed to each other although they may be offset somewhat to facilitate reception of contact elements which are not symmetrical. In that embodiment, the third cavity 87 extends transversely of an axis between the two generally opposed cavities. Other arrangements of the cavities are possible. For example, it is within the scope of this invention to have the axes of the cavities, along which the plugs are inserted, arranged at an angle of about 120° to one another.

Figure 7:
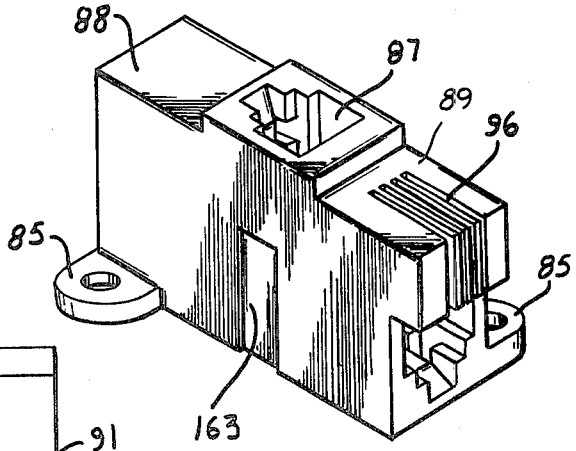
FIG. 7 is a perspective view of another embodiment of the housing of the tricoupler of FIG. 1.
Figure 8:
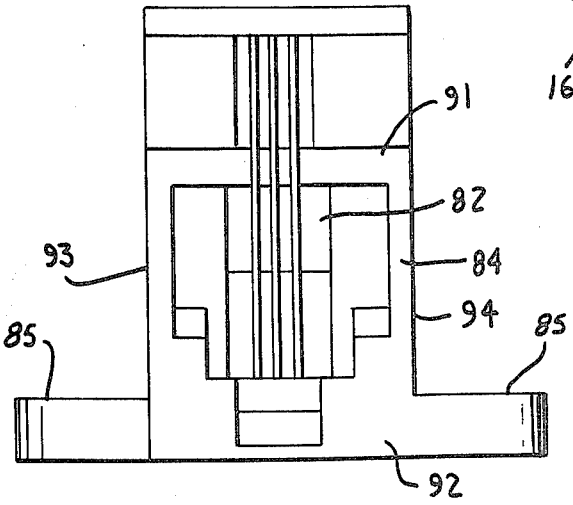
FIG. 8 is an end view of a first one of the cavities of the tricoupler of FIG. 1 to show facilities in which retroflexed end portions of the contact elements are to be disposed.

In one embodiment (see FIG. 7), the housing 80 may be modified to cause a portion 88 adjacent to the cavity 83 to be as close to the entrance of the cavity 87 as is a surface 89 of the end portion 84. This prevents any rocking of the tricoupler 30 during insertion of a modular plug 31 into the cavity 87.

The tricoupler 30 also includes a plurality of metallic contact elements 90—90. The contact elements 90—90 may be made from a resilient metallic material such as, for example, Phosphor bronze alloy. The contact elements 90—90 make electrical connections with terminals 60—60 of modular plugs 31—31 that have been inserted into the cavities 82, 83 and 87 of the housing 80. Consequently, the contact elements 90—90 function to connect electrically the modular plug of customer station equipment to inside wiring or to interconnect inside wiring in series through a wall outlet or both.

In a preferred embodiment, the housing 80 of the tricoupler 30 is unipartite and includes a cover 91 and a base 92, and sidewalls 93 and 94. A plurality of partitions 96—96 extend from the surface 89 internally through the housing 80. The partitions 96—96 are maintained spaced apart by a plurality of separators 97—97 which are interposed between the partitions. The partitions 96—96 and the separators 97—97 provide compartments for receiving the contact elements 90—90 to maintain them spaced apart and to provide suitable dielectric protection therebetween.

As can be seen in FIGS. 5 and 6, the molded cavities 82, 83 and 87 of the modular tricoupler 30 are generally identical and each include facilities for locking in a modular plug 31. Accordingly, only one of the plug-receiving cavities will be described.

Going then to the end 86, it is seen that the sidewalls 93 and 94 each are formed to include an abutment 101 (see FIGS. 5 and 6) having a vertical face 102. The vertical face 102 intersects a first ledge 103 which extends to the open end of the cavity 83. A second ledge 104 which is closer to an outwardly facing surface 106 of the base 92 than the ledge 103 extends from the partitions 96—96 to a surface 107 to which the cavity 83 opens. A ceiling 105 is spaced from the ledges 103—103 a distance which is substantially equal to the distance between the surfaces that define the height of the plug body 51.

Internal surfaces of the housing 80 which define each cavity must also include provisions for holding a plug 31 within the cavity. Such provisions are found in other modular plug connection devices. For example, the cavity 83 is similar to the cavity at each end of a coupler for telephone cords shown in U.S. Pat. No. 4,268,109 which issued on May 19, 1981 in the name of E. C. Hardesty and which is incorporated by reference hereinto. It includes a recess in an internally formed ledge for allowing the resilient locking tab 70 which is depressed during insertion of a modular plug 31 to spring-return to a normal position. The tab 70 is deflected toward the underside of the plug body 51 to form an arcuate shape so that the underside of the plug 31 can be moved slidably in engagement with side ledge surfaces of a jack cavity of the coupler into which the plug is inserted. The shoulders 75—75 move slidably in engagement with other side ledge surfaces which define the cavity. This recess in the above-identified coupler is easily moldable since its housing comprises two portions which are joined together while the jack cavity is open from each end to allow suitable access of molding tools.

The molding of the tricoupler 30 of this invention is not so straightforward. It will be recalled that the tricoupler 30 includes a unipartite housing 80 which is substantially less costly than one made of two portions that must be positioned and assembled. Although the one-piece housing 80 facilitates mechanization, access to the interior for molding certain portions becomes a problem. However, provisions still must be made for allowing the tab 70 of a plug 31 which is inserted into the tricoupler 30 to return to its normal non-depressed condition to hold the plug in its cavity.

In order to allow the locking tab 70 of the modular plug 31 to assume a non-depressed, normal position after insertion into the cavity 83, each sidewall 93 and 94 of the housing 80 is formed to include a third ledge 111 (see FIGS. 5 and 6). The ledges 111—111 extend to the external surface 107. Each ledge 111 is interrupted by an opening 113 having a rectangular cross-section and extending from the exterior surface 106 of the base 92 into the cavity 83. Those side ledge surfaces along which the shoulders 75—75 ride are interrupted so that just prior to full insertion of the plug 31, portions of the shoulders clear those ledges allowing the arched tab 70 to resume its original orientation because of its resilience. Of course, if the housing 80 were to be assembled from mating portions, the ledge construction could be made without use of the interrupted portions which form the openings 113—113. An arrangement using ledges having interrupted portions is shown in allowed application Ser. No. 241,951 which was filed Mar. 9, 1981, which issued as U.S. Pat. No. 4,380,609 in the name of E. C. Hardesty and which is incorporated by reference hereinto.

This structural arrangement of surfaces defining each cavity 82, 83 and 87 facilitates the lock-in of a modular plug 31. When a modular plug 31 is inserted into a cavity such as the cavity 83, the tab 70 thereof is depressed and bent and has an arched configuration as the flats 78—78 of the shoulders 75—75 engage and ride along the ledge portions 111—111. At the same time, the underside of the plug body 51 is moved slidably along the ledges 103—103. The inward movement of the plug body 51 is discontinued when the faces 73—73 of the recesses engage the surface 102 that extends between the abutment 101 and the ledges 103—103. As the shoulders 75—75 of the plug tab 70 pass vertically oriented surfaces 117—117 of the openings 113—113, the resilient tab 70 returns to its normal undeflected position causing the shoulders to become disposed in the interrupted portions of the sidewalls along the ledges 111. This arrangement resists withdrawal of the plug 31 from the tricoupler 30 because of the engagement of the vertical surfaces 76—76 of the tab 70 with the vertical surfaces 117—117 which define the openings 113—113.

Each cavity of the tricoupler 30 is designed to receive and to hold a modular plug 31, and to allow a customer easily to remove it if desired. The ease with which plugs 31—31 may be inserted into and removed from the modular tricoupler 30 facilitates residential and commercial wiring and interconnection of customer station equipment to the network. The free end of the tab 70 of the plug 31 extends beyond the surfaces 107—107 of the plug to permit its digital depression by a customer so that it reassumes the arched configuration of entry. The cavity 83 is formed so that with the plug body 51 in proximate engagement with the ceiling 105 and the ledges 103—103, the depression of the tab 70 moves the shoulders 75—75 a distance so that the flats 78—78 are disposed substantially at the level of the ledges 111—111 to permit withdrawal of the plug.

Each of the wire-like contact elements 90—90 includes end portions 121 and 122 (again see FIGS. 5 and 6). The retroflexed end portion 121 is received in the cavity 83 of the two generally opposed cavities, and the other end portion 122, in the third cavity 87. The end portions 121 and 122 are disposed in the plug-receiving cavities in a manner such that they are adapted to engage portions of the blade-like terminals 60—60 of modular plugs 31—31 that are inserted into those cavities.

As can best be seen in FIG. 6, each contact element 90 includes a portion 124 which extends through a passageway 125 between an upper portion 126 and one of the plurality of separators 97—97. It will be recalled that each separator 97 is disposed between adjacent partitions 96—96 or between a partition and a sidewall of the housing 80. Each passageway 125 is designed so that a radiused portion 128 of the contact element associated therewith avoids engagement with an adjacent corner 129 of the housing 80.

The portion of each contact element 90 which extends into the cavity 82 of the two generally opposed cavities is specially designed to provide electrical contact with a terminal 60 of a plug 31 without unwanted permanent deformation. In order to compensate for plug housing tolerances and terminal blade variations, particularly of the plug 31 which engages the portion of the contact element 90 intermediate its ends, the contact element must have certain characteristics. It must be capable of deflection with the accompanying build-up internally of reaction forces to accommodate the inserted plug 31 to achieve suitable contact pressure without excessive permanent deformation of segments of the contact element 90. Should the deflection be accompanied by a permanent set, the wire-like contact element 90 would be bent permanently, resulting in reduced circuit contact pressure upon successive plug insertions.

In order for each contact element 90 to have these characteristics, that portion of it which extends into the cavity 82 includes a loop 131 which shifts when a portion of it is engaged by a terminal 60. By allowing the loop 131 to flex in a relatively short distance between cavities, a permanent set of the wire-like contact element 90 is avoided. By using the loop 131, generous deflection is allowed before the build-up of excessive forces, which could cause a permanent deformation of the wire-like contact element.

The loop 131 of each contact element 90 is configured to control the deflection characteristics of a portion of the contact element intermediate its ends. The loop 131 of each contact element 90 is disposed and supported in its undeflected condition as shown in FIGS. 5 and 6. The loop 131 of each contact element 90 includes two segments 132 and 133. The segment 132 makes a turn about one of the separators 97—97 positioned between two partitions 96—96 or between a partition and wall of the housing 80. As it makes its turn, it engages and is supported by a corner portion 136 of the separator which spaces apart the partitions 96—96 that form the compartment in which it is positioned. This corner portion 136 is a surface which extends transversely between partitions 96—96. As can be observed from the drawings, an opposite corner 137 of the separator 97 is not engaged by the contact element 90 in its turn.

Following on from the vicinity of the corner 137, the segment 133 of the loop 131 extends toward the center of the tricoupler 30. Each contact element 90 is unsupported as it dips downwardly in an offset into a chamber 141 disposed below a portion 142 of the jack cavity 87. Each chamber 141 is formed by two adjacent partitions 96—96 or by a partition and an adjacent wall of the housing 80.

From its chamber 141, each contact element 90 extends angularly upwardly past, but spaced from, the associated portion 142. Adjacent to the portion 142, the contact element 90 turns at a corner 146 and includes a portion 147 that extends horizontally, as viewed in FIG. 6, through a passageway 148. At the end of the horizontal portion 147, the contact element 90 includes a bend or radiused portion 149 that connects with the retroflexed end portion 121.

Figure 9:
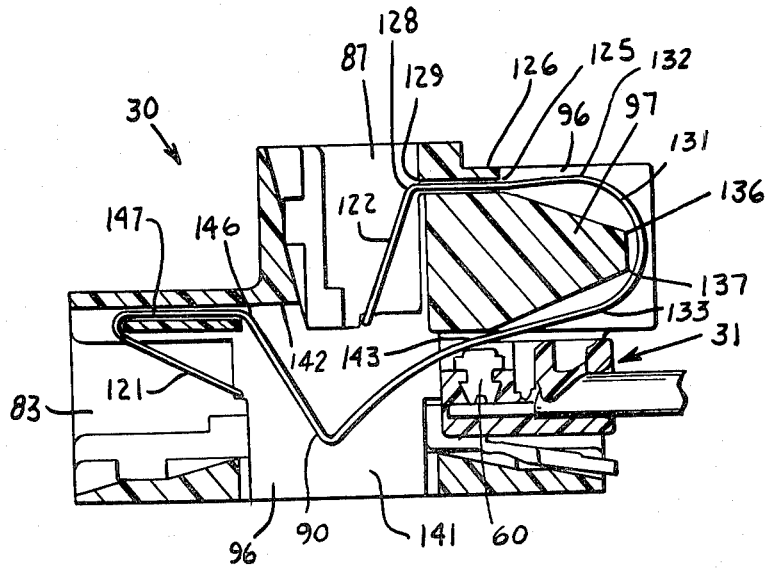
FIG. 9 is an elevational view in section of the tricoupler with a modular plug disposed in the first one of the cavities.

When a modular plug 31 is inserted into the cavity 82, each terminal blade 60 engages a contact element 90 along a portion 143 of the second segement 133 of its loop 131 (see FIG. 9). As the plug 31 is moved to its fully inserted position, the loop 131 is shifted to the position shown in FIG. 9 where it is spaced from the corner 136 and an opposite corner 137 of the associated separator 97. The contact element 90 is able to experience a considerable amount of deflection to accommodate the modular plug 31 while developing suitable contact pressure without any accompanying permanent deformation. If that modular plug 31 is withdrawn from the cavity 82, the loop 131 of the contact element 90 has sufficient resiliency so that it shifts and returns to its original position as shown in FIG. 6.

The loop 131 is moved without any significant resulting movement in the end portions 121 and 122 which would adversely the electrical contact pressure between the contact element 90 and the terminals 60—60 of inserted plugs 31—31. This is accomplished by means of the two passageways 125 and 148. When each contact element 90 is mounted in the housing 80, one side of the loop 131 engages the corner portion 136 of the plastic separator 97. This positions the loop 131 when the contact element 90 is inserted into the housing and prevents the loop from moving toward the passageway 125 adjacent to the customer cavity 87 when the plug is inserted into the cavity 82. The passageway 125 provides suitable confinement for preventing swinging movement of the end portion 122. As a result, there is insubstantial movement of the end portion 122 in the customer jack cavity 87.

As will be recalled, in the end 86 of the housing 80, each contact element 90 is formed with a bend upwardly angularly from the chamber 141 and then with a second bend 146 into its associated passageway 148. The lastmentioned bend 146 keeps it from moving linearly and the passageway 148 confines it in transverse planes. As a result, there is substantially no movement of the retroflexed end portion 121 in the cavity 83.

Figures 10, 11, 12:
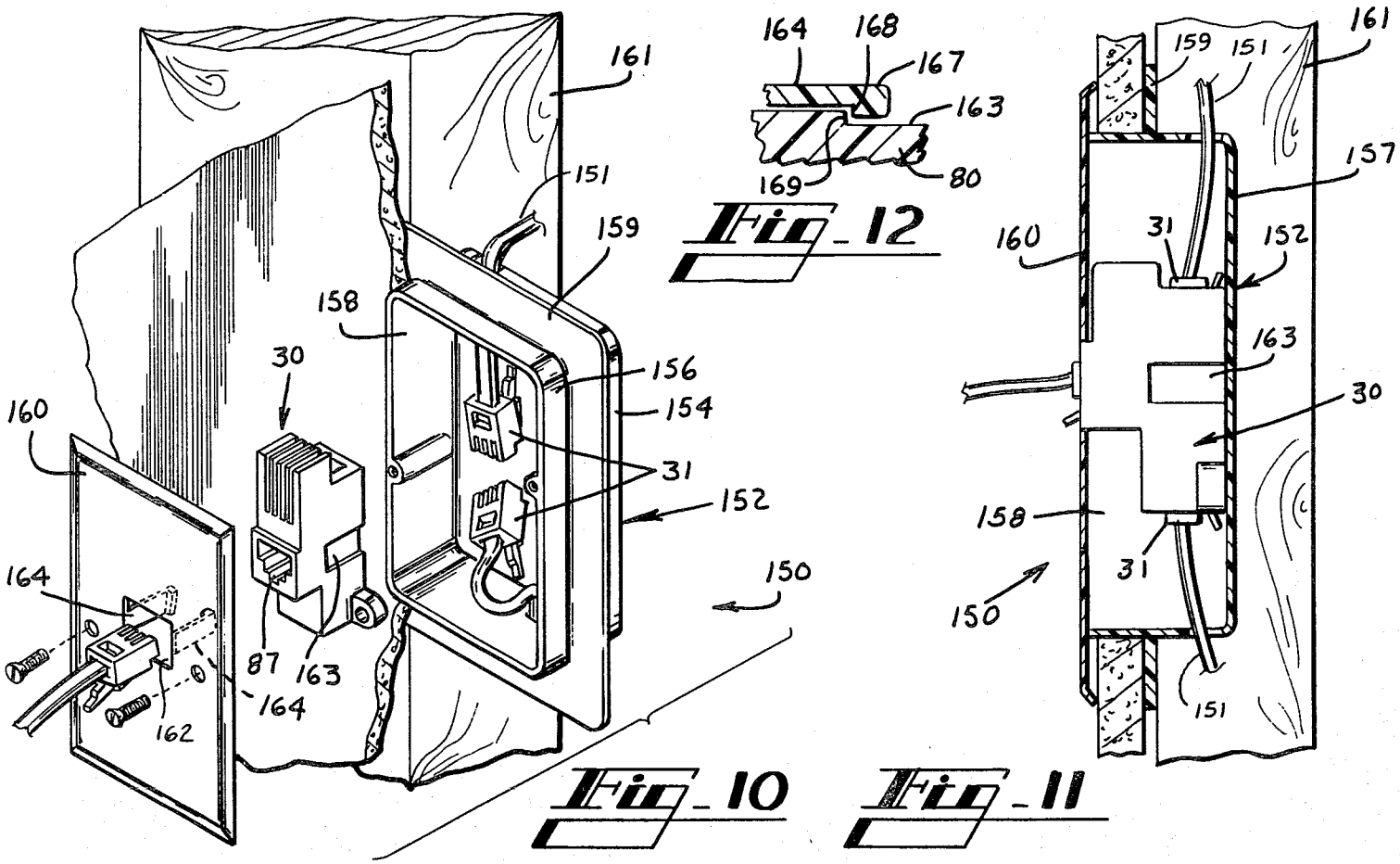
FIG. 10 is a perspective view of the tricoupler a cover to which the tricoupler is adapted to be secured and a wall receptacle to which the cover is adapted to be secured.
FIG. 11 is an elevational view of the tricoupler and receptacle of FIG. 10.
FIG. 12 is a detailed view of a latch arrangement for holding a cover to the tricoupler.

In FIGS. 10 and 11, there is shown a device 150 for providing inwall telephone service between inside wiring 151—151 terminated with modular plugs 31—31 and customer station equipment. The device 150 includes a receptacle 152 which houses a tricoupler 30. The tricoupler 30 is capable of being received in any number of receptacles. The receptacle 152 includes a portion 154 having sidewalls 156—156, a base 157, and an open side 158. A flange 159 extends outwardly from the sidewalls 156—156 and is used to mount the receptacle 152 to a supporting member 161 within a wall. The tricoupler 30 is adapted to be secured to a cover 160 which is mounted to the receptacle 152 such that the third cavity 87 faces outwardly and is exposed through an opening 162 in the cover. The cover 160 encloses the receptacle 152 in much the same way that a cover plate covers the well-known electrical outlet for home or business use. Preferably, the cover 160 and the receptacle 152 are made of a rigid plastic material which is easily moldable. This arrangement differs from the conventional wall outlet in which inside wiring is connected to a device inside the receptacle with a jack in the cover plate being connected by wires to the device inside the receptacle.

As can be seen in FIGS. 1, 5 and 10, the housing 80 is formed with a groove 163 on each of two opposing sides. These grooves 163—163 are adapted to receive latching tabs 164—164 which depend from the cover 160.

Going now to FIG. 12, it can be seen that each of the latching tabs 164—164 includes an end portion 167 having a latch 168 which is adapted to engage an end wall or keeper 169 of the groove 163 in the side of the tricoupler 30. The length of the grooves 163—163 from the base 92 toward the cavity 87 is such that when the cover 160 is positioned over the housing 80, the latches 168—168 are adapted to engage the keepers 169—169. The latch 168 and the end wall 169 are configured to provide a generally right angle corner aong the surfaces which engage each other. The keeper 169 of each groove of the tricoupler housing 80 is always at right angles to adjoining surfaces of the housing as is shown in FIG. 12. By this arrangement, the cover 160 is secured to the tricoupler 30 to the extent that the cover must be removed from the receptacle 152 and substantial forces applied to remove the cover from the tricoupler 30. This prevents inadvertent dislocation of the tricoupler 30 from the cover 160 when a customer inserts a plug 31 into the cavity 87.

Figure 14:
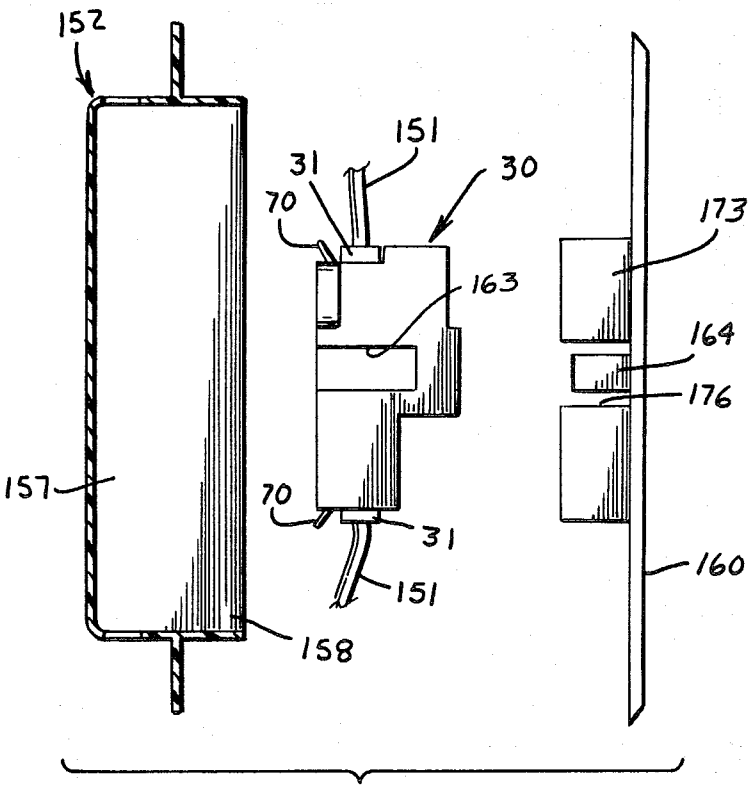
FIGS. 13 and 14 are plan and elevational views of an alignment device which cooperates with the latch arrangement of FIG. 12.
Figure 13:
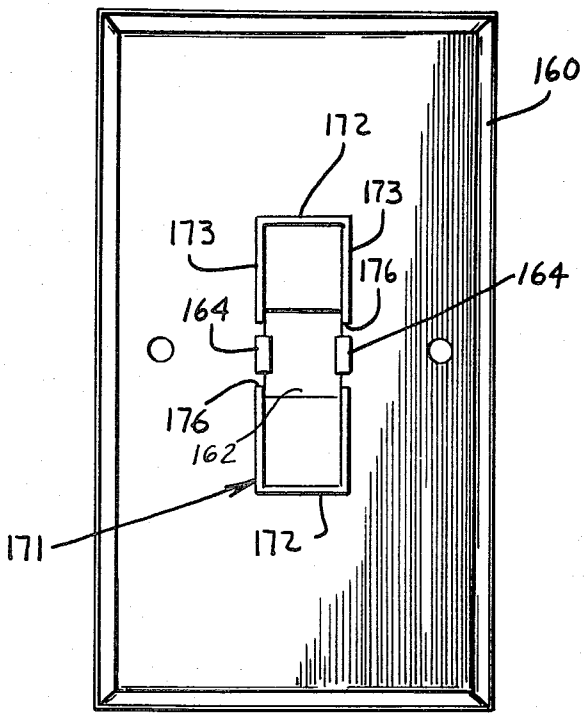

Further, a preferred embodiment of the cover 160 includes an alignment fence 171 (see FIGS. 13 and 14) to assure that the latching tabs 164—164 are received in the grooves 163—163 of the housing 80. The alignment fence 171 is disclosed and claimed in copending commonly assigned application Ser. No. 442,930 which was filed on even date herewith in the names of M. W. Brzostek, E. C. Hardesty and E. M. Hutchins. Should a latching tab 164 be inserted inadvertently into the cavity 87, it could deform and undesirably reposition one or more of the end portions 122—122 of the contact elements 90—90. The alignment fence 171 includes two end portions 172—172 and two side portions 173—173 which cooperate to form a perimetral wall depending from the cover 160 (see FIG. 14). Openings 176—176 are provided in the side portions 173—173 to provide for the latching tabs 164—164. The end portions 172—172 and the side portions 173—173 are spaced so that when the cover 160 is mounted to the tricoupler 30, the end portions and side portions engage the ends 84 and 86 and the side walls 93 and 94 of the housing 80 of the tricoupler 30.

Figure 15:
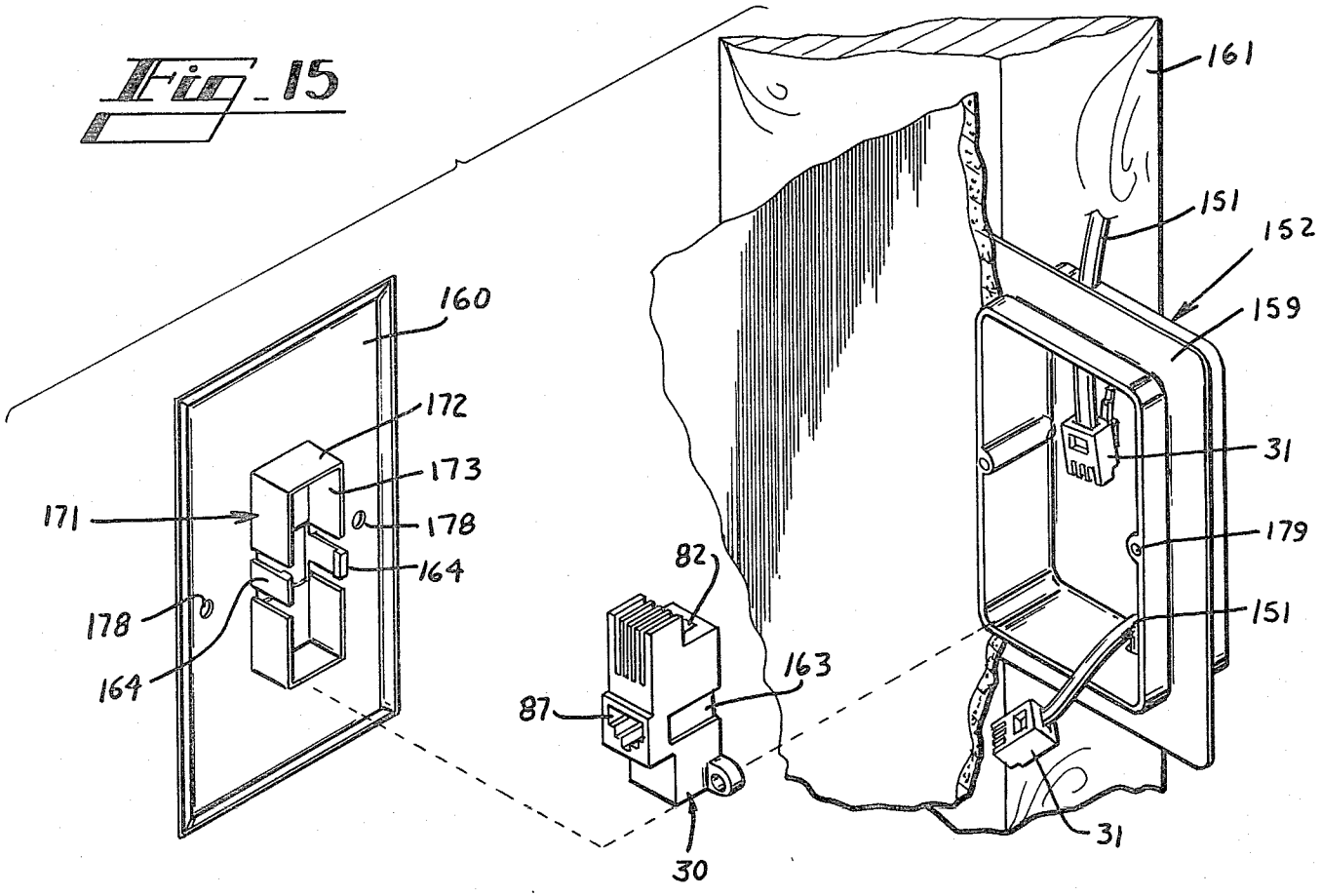
FIG. 15 is a perspective view to show a preferred embodiment of a cover plate, to which is to be secured a tricoupler, and a receptacle to which the cover plate is to be mounted.

Going now to FIG. 15, there is shown a perspective view of the inwall outlet of this invention which will be used to describe an assembly technique. It will be observed that the inside wires 151—151 terminated with modular plugs 31—31 extend into the receptacle 152 which is secured to a supporting member 161. A modular tricoupler 30 is secured to a cover plate 160 by causing the latching tabs 164—164 to be recieved in the grooves 163—163 of the tricoupler housing 80. The alignment fence insures that neither tab 164 is inserted into the cavity 87. Then the cover plate 160 with the tricoupler 30 secured thereto is mounted to the receptacle 152 by turning fasteners (not shown) through holes 178—178 in the cover plate into sockets 179—179 in the receptacle. The sockets 179—179 in the receptacle 152 are molded therein in a manner to avoid any conflict with the lugs 85—85 formed on the housing 80. Should it be desired to disengage the cover 160 from the tricoupler 30, the customer need only remove the cover from the receptacle 152 to provide access to the latching tabs 164—164.

Figure 16:
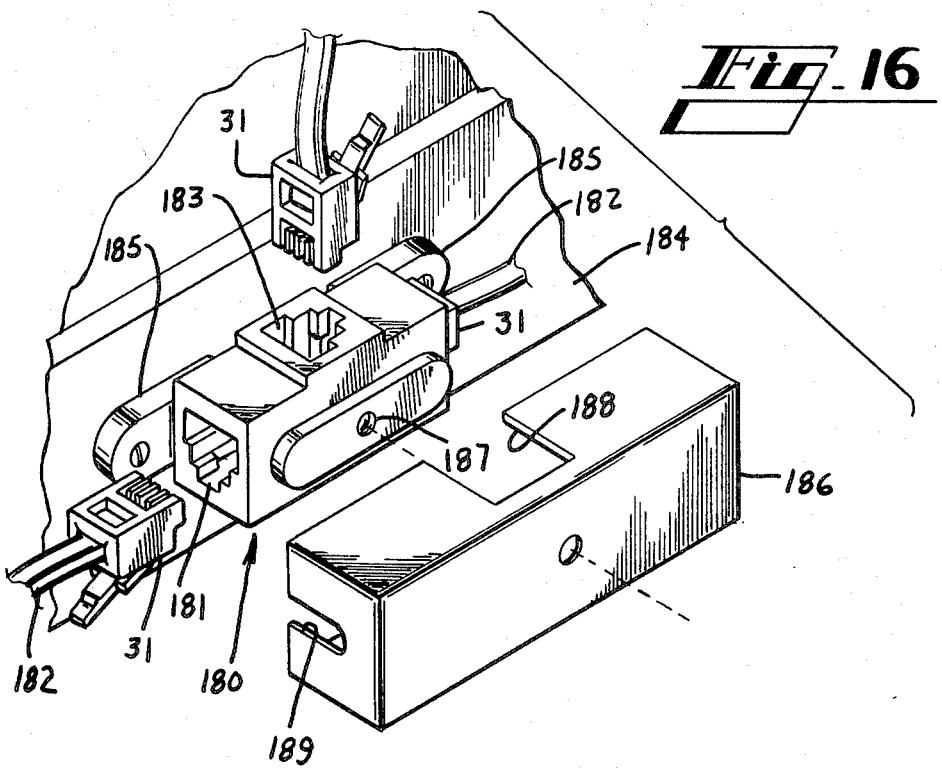
FIG. 16 is a perspective view of another embodiment of a tricoupler of this invention which is mounted on a baseboard and which includes a top entry cavity that is adapted to receive a modular plug connected to customer station equipment.

In FIG. 16, there is shown a tricoupler which is designated generally by the numeral 180 and which includes opposing cavities 181—181 for receiving plugs 31—31 attached to inside service wiring 182—182. The tricoupler 180 also includes a top entry cavity 183 for receiving a third modular plug 31 that extends to customer station equipment. The tricoupler 180 is adapted to be attached to a baseboard 184 through lugs 185—185 and adapted to have a cover 186 attached thereto by a fastener turned into an opening 187. As can be seen in FIG. 16, the cover 186 encloses the tricoupler with an opening 188 over the top cavity 183 and openings 189—189 for enclosing ends of the tricoupler.

Figure 17:
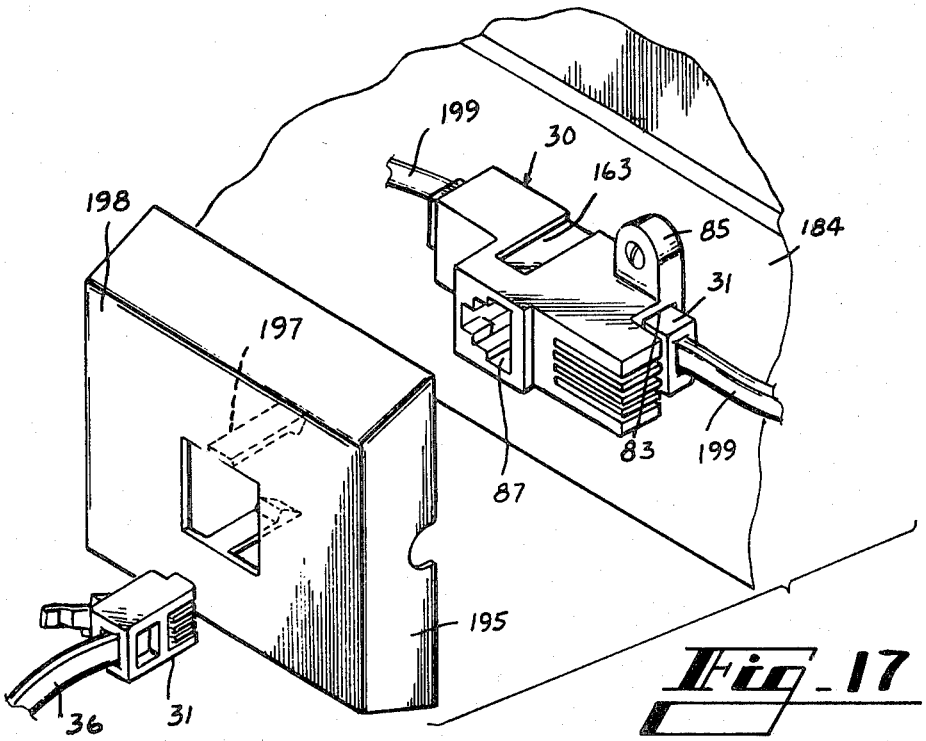
FIG. 17 is a perspective view of the tricoupler of FIG. 1 which is mounted on a baseboard molding with a front entry cavity designated to receive a plug which is connected to customer station equipment.
Figure 21:
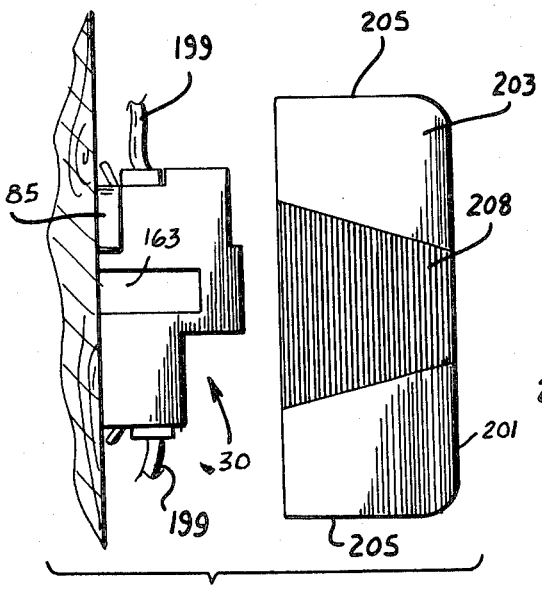
FIG. 21 is a plan view of the cover of FIG. 18 aligned with a tricoupler that is secured to a baseboard molding.

In FIG. 17, the tricoupler 30, having opposed cavities 82 and 83 and a front entry cavity 87 for receiving a modular plug 31 that is connected to a line cord 36 extending to customer station equipment, is mounted on the baseboard 184. As in the embodiment shown in FIG. 16, the tricoupler 30 is adapted to be secure to the baseboard 184 by the lugs 85—85 and to be enclosed with a cover 195. Also, the tricoupler 30 includes the side grooves 163—163 for receiving latching tabs 197—197 which depend from the cover 195. The cover 195 has appropriate openings at each end and along a front side 198 to facilitate entry of plugs 31—31 that are connected to service cables 199—199 and a cord 36 connected to customer station equipment.

A preferred embodiment of a cover 200 for the tricoupler 30 of FIG. 17 which is attached to an external surface of a wall is shown in FIGS. 18-21. The cover 200 includes a top 201, two sides 203—203 in open side 204 and two ends 205—205. Each of the ends 205—205 is formed with a slotted opening 206 through which a service wire 199 (see FIG. 17) extends to a modular plug 31 that is received in one of the opposed end cavities of the tricoupler. Portions of the sides 203—203 are formed with striations 208—208 to provide gripping surfaces for a user who wishes to install or to remove the cover 200.

Figure 19:
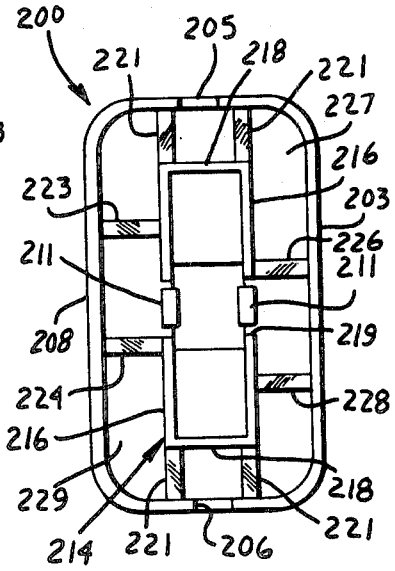
FIG. 19 is a view of the cover of FIG. 18 taken from its underside.
Figure 18:
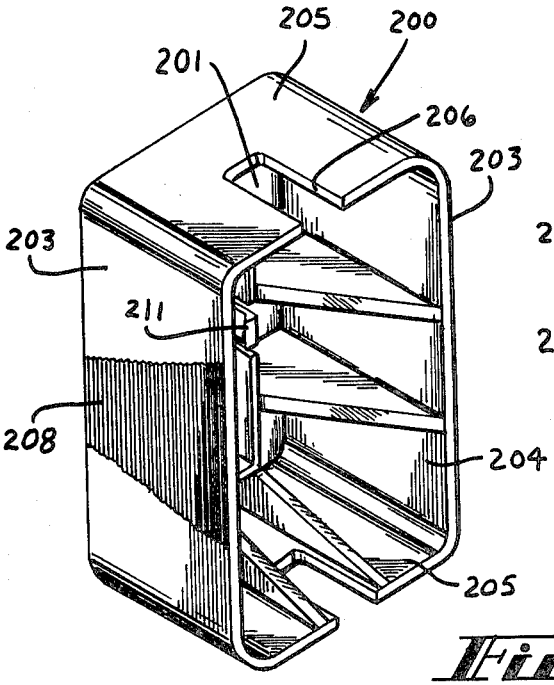
FIG. 18 is a perspective view of a preferred embodiment of a cover for the tricoupler of FIG. 17.

As can best be seen in FIGS. 18 and 19, the cover 200 also includes a pair of latching tabs 211—211 which project from the top 201 toward the open side 204. The latching tabs 211—211 are adapted to snap-lock into the grooves 163—163 (see FIG. 17) on the sides of the tricoupler 30 when the cover is positioned over the tricoupler. Unlike the arrangement which is shown in FIGS. 10 and 12, the latching tabs 164—164 of the cover 195 or cover 200 of the baseboard-mounted tricoupler 30 are modified to avoid a right angle surface for each of the latches 168—168. Rather, each latch 168 is sloped somewhat to reduce the force that must be applied to remove the cover from the housing 80. With this arrangement, substantial forces are not required to remove the cover from the housing 80 of the baseboard mounted tricoupler 30. This presents no problem inasmuch as there is no danger of dislodging the tricoupler from the cover when inserting a plug 31 into the cavity 87 because the tricoupler is secured to the baseboard 184.

Advantageously, the cover 200 includes guide provisions for insuring that the latching tabs 211—211 are received in the grooves 163—163 on the sides of the tricoupler 30 and not inadvertently moved into the cavity 87 of the front facing jack cavity. These provisions include an alignment fence 214 (see FIG. 19) comprising two side portions 216—216 and two end portions 218—218. Each of the side portions 216—216 is interrupted by an opening 219 to accommodate a latching tab 211.

Figure 20:
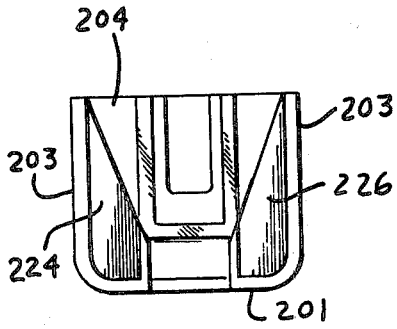
FIG. 20 is an end sectional view of the cover of FIG. 18.

The guide provisions also include a plurality of camming wedges spaced about the alignment fence 214 and extending between the alignment fence and the sides and ends of the cover 200. Two wedges 221—221 are formed at each end of the alignment fence, two wedges 223 and 224 on one side and two, 226, 228 on the other side of the fence. Each of the wedges decreases in height from an exterior wall of the cover 200 to the alignment fence (see FIGS. 18 and 20). Should the fence 214 not be aligned with the tricoupler 30 as the cover 200 is positioned over the tricoupler, the wedges engage portions of the tricoupler and cam the cover into its aligned position. This action may be enhanced by continuing the slope of the camming wedges across the sides and ends of the alignment fence 214, as is shown in FIG. 20.

It should be observed from FIG. 19 that the side wedges 223,224 are offset from the side wedges 226,228. This is done in order to avoid engagement of the wedges with the mounting lugs 85—85 of the housing 80. Viewing now FIGS. 17 and 19, it should be appreciated that as the cover 200 is positioned over the tricoupler 30, one lug 85 is received in a portion 227 of the cover defined between an end wedge 221 and the wedge 226. The other lug 85 is received in a space 229 between an end wedge 221 andthe side wedge 224.

It is to be understood that the above-described arrangements are simply illustrative of the invention. Other arrangements may be devised by those skilled in the art which will embody the principles of the invention and fall within the spirit and scope thereof.

What is claimed is:

1. A tricoupler for modular wiring systems, said tricoupler comprising:

a housing which is made of a dielectric material, said housing including first, second and third modular plug-receiving cavities; and a wire-like contact element which is made of a relatively resilient metallic material and which is mounted in said housing, said wire-like contact element including one end portion which extends into said second cavity, another end portion which extends into said third cavity, and a loop which extends from the vicinity of said third cavity, through said first cavity toward said second cavity, and which is controlled to deflect sufficiently without permanent deformation to develop suitable contact pressure when engaged by a terminal of a modular plug that is inserted into said first cavity.

2. The tricoupler of claim 1 wherein said housing is unipartite.

3. The tricoupler of claim 1, wherein said first and second cavities are generally opposed to each other.

4. The tricoupler of claim 1, wherein said tricoupler includes a plurality of contact elements and said housing includes a plurality of partitions which extend adjacent to each of said cavities and a plurality of separators which maintain said partitions spaced apart, said partitions and said separators providing compartments in which are disposed portions of said contact elements between said cavities.

5. The tricoupler of claim 4, wherein said loop of each contact element is configured to cause a portion to be engaged by a transversely extending surface of one of said separators of said housing prior to its engagement by a terminal of a modular plug, said portion of each said loop being disengaged from said transversely extending surface of the separator when said loop is engaged by a terminal of a modular plug that is inserted into said first cavity.

6. The tricoupler of claim 5, wherein each said contact element between said first cavity and said second cavity includes an offset which extends into a chamber of said housing disposed between said first and second cavities.

7. The tricoupler of claim 6, wherein the deflection is a function of the length of the contact element between said offset and said first cavity.

8. The tricoupler of claim 6, wherein said housing includes a plurality of passageways adjacent to said second and third cavities and wherein each said contact element includes a portion connected to its one end portion and disposed in one of said passageways adjacent to said second cavity and a portion connected to its other end portion and disposed in one of said passageways adjacent to said third cavity, said passageways being defined by walls which provide lateral confinement for said portions of said contact elements therein and which are effective to prevent substantially pivotal movement of said end portions when a modular plug is inserted into said first cavity.

9. The tricoupler of claim 8, wherein said portion of each contact element which is disposed in a passageway adjacent to said second cavity is connected through a bend to said offset and wherein said portion which is disposed in a passageway adjacent to said third cavity is connected through a bend to said other end portion.

10. The tricoupler of claim 1, wherein a lug is provided on each of two opposed sides of said housing for securing said tricoupler to a supporting member, said lugs being offset from each other.

11. The tricoupler of claim 1, wherein said tricoupler is adapted to be received in a receptacle which is supported by a wall and which includes a cover to which said tricoupler is adapted to be mounted, said tricoupler including a groove which is formed in each of two opposing sides to receive latching tabs of the cover to secure the tricoupler to said cover.

12. A device for providing an interconnection of at least one service cable and a modular plug that is connected to customer station equipment, said device comprising:

a receptacle having a base, sides and an open face opposite to said base, said receptacle further including means for mounting said receptacle to a supporting member within a wall;

a tricoupler which is adapted to be received in said receptacle and which comprises:

a housing which is made of a dielectric material, said housing including first, second and third modular plug-receiving cavities; and a plurality of wire-like contact elements which are made of a relatively resilient metallic material and which are mounted in said housing, each having one end portion which extends into said second cavity and another end portion which extends into said third cavity, each said wire-like contact element also having a loop which extends from the vicinity of said third cavity, through said first cavity toward said second cavity, and which is controlled to permit sufficient deflection of segments of said loop when said loop is engaged by a terminal of a modular plug that is inserted into said first cavity to develop suitable contact pressure with the terminal without permanent deformation of the segments; and a cover which is adapted to enclose said open face of and to be mounted to said receptacle and which includes means for securing said tricoupler to said cover, said cover including an opening which is aligned with said third cavity of said tricoupler when said tricoupler is secured to said cover.

13. The device of claim 12, wherein said housing includes a plurality of partitions which extend adjacent to each of said cavities and a plurality of separators which maintain said partitions spaced apart, said partitions and said separators providing compartments in which are disposed portions of said contact elements between said cavities.

14. The tricoupler of claim 13, wherein each said loop is configured to cause a portion to be engaged by a transversely extending surface of one of said separators of said housing prior to its engagement by a terminal of a modular plug and wherein said portion of said loop is disengaged from said transversely extending surface when said loop is engaged by a terminal of a modular plug that is inserted into said first cavity.

15. The tricoupler of claim 14, wherein each said contact element between said first cavity and said second cavity includes an offset which is received in a chamber of said housing which is disposed between said first and second cavities, the deflection of each said loop being a function of the length of the contact element between said offset and said first cavity.

16. The device of claim 15, wherein said housing includes a plurality of passageways adjacent to said second and third cavities and wherein each said contact element includes a portion connected to its one end portion and disposed in one of said passageways adjacent to said second cavity and a portion connected to its other end portion and disposed in one of said passageways adjacent to said third cavity, said portion of each contact element which is disposed in a passageway adjacent to said second cavity being connected through a bend to said offset and said portion which is disposed in a passageway adjacent to said third cavity being connected through a bend to said other end portion, said passageways being defined by walls which provide lateral confinement for said portions of said contact elements therein and which are effective to prevent substantially any pivotal movement of said end portions when a modular plug is inserted into said first cavity.

17. The device of claim 12, wherein a laterally extending lug is provided on each of two opposed sides of said housing for mounting said tricoupler to a supporting surface with said lugs being offset from each other, wherein said cover includes a pair of latching tabs which depend from said cover, and wherein said tricoupler includes a groove which is formed in each of two opposing sides to receive said latching tabs of the cover to secure to said tricoupler to said cover, and wherein said lugs are offset from each other to allow said grooves the said latching tabs to be aligned.

18. The device of claim 12, wherein said means for securing said tricoupler to said cover includes a pair of latching tabs which depend from said cover and wherein said tricoupler includes a groove formed along each side thereof, each said latching tab being formed with a latch and each said groove being formed with an end wall that cooperate to hold said tricoupler to said cover and which upon the application of a predetermined force are caused to separate to permit removal of said cover from said tricoupler.

* * * * *